US007604672B2

(12) United States Patent
Smith et al.

(10) Patent No.: US 7,604,672 B2
(45) **Date of Patent: *Oct. 20, 2009**

(54) ADDITIVE FOR HYDROCARBON FUEL AND RELATED PROCESS

(75) Inventors: Dwight Morrell Smith, Littleton, CO (US); Abdul R. Chughtai, Broomfield, CO (US); James Dadura, Chicago, IL (US); James Dadura, Jr., legal representative, Chicago, IL (US)

(73) Assignee: EnviroFuels, LLC, Houston, TX (US)

( * ) Notice: Subject to any disclaimer, the term of this patent is extended or adjusted under 35 U.S.C. 154(b) by 620 days.

This patent is subject to a terminal disclaimer.

(21) Appl. No.: 10/875,765

(22) Filed: Jun. 23, 2004
(Under 37 CFR 1.47)

(65) Prior Publication Data

US 2005/0028434 A1 Feb. 10, 2005

Related U.S. Application Data

(60) Provisional application No. 60/480,701, filed on Jun. 23, 2003.

(51) Int. Cl.
*C10L 1/22* (2006.01)
*C10L 1/12* (2006.01)

(52) U.S. Cl. ..... 44/408; 44/457

(58) Field of Classification Search ..... 44/408, 44/457; 423/306, 307, 308, 312
See application file for complete search history.

(56) References Cited

U.S. PATENT DOCUMENTS

| | | | | |
|---|---|---|---|---|
| 2,742,351 | A * | 4/1956 | Rogers et al. | 44/370 |
| 3,270,497 | A * | 9/1966 | Malick | 44/443 |
| 3,445,206 | A | 5/1969 | Revukas | |
| 3,476,533 | A | 11/1969 | Eckert | |
| 3,483,178 | A | 12/1969 | Crutchfield et al | |
| 3,644,106 | A | 2/1972 | Burnop | |
| 3,652,242 | A | 3/1972 | Andress et al. | |
| 3,734,963 | A | 5/1973 | Langer et al | |
| 3,795,495 | A | 3/1974 | Howland | |
| 3,909,430 | A | 9/1975 | Hotten | |
| 3,968,157 | A | 7/1976 | Hotten | |
| 4,107,058 | A | 8/1978 | Clarke et al. | |
| 4,690,687 | A | 9/1987 | Johnston et al. | |
| 4,720,288 | A | 1/1988 | Croudace et al. | |
| 5,034,114 | A | 7/1991 | Kukin | |
| 5,084,263 | A | 1/1992 | McCoy et al. | |
| 5,310,419 | A | 5/1994 | McCoy et al. | |
| 5,540,788 | A | 7/1996 | Defalco et al. | |
| 5,630,852 | A | 5/1997 | Placek | |
| 6,361,623 | B1 | 3/2002 | Ishikura et al. | |
| 2002/0038525 | A1 | 4/2002 | Callis et al. | |
| 2003/0099758 | A1 * | 5/2003 | Book et al. | 426/641 |
| 2003/0226312 | A1 | 12/2003 | Roos et al. | |
| 2004/0182481 | A1 | 9/2004 | Smith et al. | |

FOREIGN PATENT DOCUMENTS

| | | |
|---|---|---|
| DE | 920319 | 11/1954 |
| DE | 920319 C | 11/1954 |
| GB | 776 502 | 6/1957 |
| GB | 2053963 | 2/1981 |
| GB | 2053963 A | 2/1981 |
| HU | P0300105 | 1/2003 |
| JP | 60080007 | 5/1984 |
| WO | WO 01/05911 A2 | 1/2001 |
| WO | WO 01/05913 A1 | 1/2001 |
| WO | WO01/38464 A1 | 5/2001 |
| WO | WO 2004/069965 | 8/2004 |
| WO | WO 2004/070081 | 8/2004 |
| WO | WO 2005/001004 A2 | 1/2005 |

OTHER PUBLICATIONS

Filing in Patent File Under MPEP 2001.06(c), U.S. Appl. No. 11/507,851 Plaintiff's First Amended Petition, Cause No. 2003-06080, in District Court of Harris County, Texas filed Apr. 23, 2004.

* cited by examiner

*Primary Examiner*—Cephia D Toomer
(74) *Attorney, Agent, or Firm*—Bracewell & Giuliani LLP

(57) ABSTRACT

The present invention relates to the field of fuel additives for hydrocarbon fuels that acts to enhance efficiency and/or reduce pollution. The fuel additive is a phosphorus-containing composition that can be dispersed in hydrocarbon fuels or liquid carriers for combustion with the fuel in a combustion zone.

10 Claims, No Drawings

ADDITIVE FOR HYDROCARBON FUEL AND RELATED PROCESS

RELATED APPLICATIONS

This patent application claims priority to U.S. Provisional Patent Application Ser. No. 60/480,701, filed on Jun. 23, 2003, which is incorporated by reference in its entirety.

TECHNICAL FIELD OF THE INVENTION

The present invention relates to the field of fuel additives, in particular, to an additive for hydrocarbon fuels to enhance efficiency and/or reduce pollution.

BACKGROUND OF THE INVENTION

Many hydrocarbon fuels have been used, each with their own advantages and drawbacks. Examples of such fuels include gasoline, natural gas, diesel, kerosene, jet fuel, LPG, heavy distillates, bunker fuel, ethanol, coal, other solid hydrocarbon fuels and the like. Chemical compounds have been used as fuel additives over the past century to improve various parameters, such as octane number, of various fuels. The use, and subsequent banning, of lead in gasoline has been known for a long time. Tetraethyl lead showed a positive effect on octane and a profoundly negative effect on the environment.

In addition to tetraethyl lead, several elements are known to have combustion catalyst characteristics in gasoline or other hydrocarbon fuels. Examples, in addition to lead, are manganese, iron, copper, cerium, calcium and barium. Each of these elements has advantages and disadvantages in particular applications. Drawbacks of certain iron compounds include limited solubility in gasoline, toxicity, and expense as an additive. Interaction with sulfur and creation of sulfide precipitate may also occur, which is undesirable.

Another commonly-used additive in gasoline is MTBE. While this compound boosts octane levels significantly, the compound is thought to be carcinogenic. Also, it mixes easily with water which is hazardous should there be a leak. Gasoline containing MTBE leaking from an underground tank at a gas station could potentially leach into groundwater and contaminate wells. As a result of the believed negative potential of MTBE on the environment, ethanol is also being evaluated as a gasoline additive to boost octane.

In addition to the industry goal of improved combustion efficiency, smoke emissions reduction is also a concern, particularly for diesel fuel applications. The industry has not made substantial progress on development of a fuel additive for reducing smoke and particulate emissions Finally, adjustment of combustion parameters is made to attempt to maximize function to reduce CO and NOx. In spite of these and combinations of these attempts to minimize pollutants, fuel combustion continues to be a focus of interest to improve fuel efficiency and reduce pollutants.

A fuel additive that includes a combustion catalyst to reduce smoke and particulate emissions from bus, truck and automobile engines operating on gasoline fuels would be advantageous. Also advantageous would be a fuel additive that increases efficiency and/or decreases pollutants for diesel fuel applications. It would be advantageous to reduce smoke, particulate and nitrogen emissions from fuel applications. An additive that does not result in the formation of precipitates would be also advantageous. An additive for hydrocarbon fuel that reduces level of NOx produced would also be advantageous. Finally, an additive that remains stable during the combustion process would be advantageous.

SUMMARY OF THE INVENTION

The present invention includes a fuel additive and a method of using the additive in relation to hydrocarbon fuel.

The fuel additive of the invention includes a phosphorus-containing parent solution containing $[Y]_xH_2PO_4$, $[Y]_{x+1}$ HPO4, where Y is a cation. Y does not have to be the same cation in both salt compounds. The cationic portion of the salt components can be any cation, with potassium being a preferred cation. In this case, the preferred components would be $KH_2PO_4$, $K_2HPO_4$. These salts are at least partially dispersed in water or other appropriate solvent to create the phosphorus-containing parent solution. Advantageously, this embodiment of the fuel additive is an ammonia-free solution. One preferred embodiment includes adding these components in the presence of water to create the phosphorus-containing parent solution as an aqueous parent solution. The water acts as the solvent. Other preferred solvents include hydrocarbons or alcohols. Another group of preferred cations would be the alkali metals or Group 1A. While $NH_4$ used as Y creates a fuel additive that enhances fuel performance, there are instances when it is preferred to avoid ammonium and thereby ammonia altogether.

The phosphorus-containing parent solution is added or mixed with a carrier fluid. The carrier fluid is a fluid that is operable to maintain the salts within the carrier fluid in at least a partially dispersed state and that is miscible, or capable of being maintained in solution, in the hydrocarbon fuel. In a preferred embodiment, the solvent is largely removed from the phosphorus-containing parent solution with carrier fluid through thermal means to create the fuel additive. The fuel additive is operable to enhance combustion when placed into contact with fuel in a combustion zone and combusted. Enhanced combustion means that fuel efficiency is increased when compared to fuel without the fuel additive, or that pollutant output in an exhaust gas from the combustion is decreased or a combination of these effects. Typical pollutants can include NOx, particulate matter, carbon monoxide and other recognized pollutants resulting from the combustion of hydrocarbon fuel. It is noted that different geographical areas focus on minimizing a particular pollutant depending on air characteristics. Reduction of a target pollutant or a combination of pollutants is highly advantageous. Alternately, increased fuel efficiency results in a total lower volume of pollutants, as well as economic advantage.

Another preferred embodiment of the phosphorus-containing parent solution includes the addition of $[NH_4]_2HPO_4$ to the $[Y]_xH_2PO_4$, $[Y]_{x+1}$HPO4, and water. Yet another embodiment includes the addition of $NH_4C_2H_3O_2$ where $C_2H_3O_2^-$ ion is an acetate group such that the solution contains $[Y]_xH_2PO_4$, $[Y]_{x+1}$HPO4, $[NH_4]_2HPO_4$, NH4C2H3O2 and water. When the fuel additive is prepared using ammonium compounds, ammonium compounds being defined as those compounds containing $NH_x$ groups, the nitrogen in the solution is essentially all in the form of arrimonium ions. There is at most a negligible amount of free ammonia. In a preferred embodiment, the solution has a pH between about 6.0 and 8.0.

Another preferred embodiment of the phosphorus-containing parent solution includes the addition of $[Y]_xPO_4$ to the $[Y]_xH_2PO_4$, and $[Y]_{x+1}$HPO4.

While orthophosphoric acids have been described, also called phosphoric acids, this includes pyrophosphoric acids, which are the condensed analogs of orthophosphoric acid. The difference being that, through the process to condense the orthophosphoric acid, the $PO_4^{3-}$ become $P_2O_7^{2-}$ or other condensed phosphates. Therefore, $[Y]_xH_2PO_4$, and $[Y]_{x+1}$ HPO4 are precursors to pyrophosphoric acids. The use of the pyrophosphoric and other condensed forms is therefore encompassed within the definition of the orthophosphate form.

The phosphorus-containing parent solution of one embodiment of the invention can be used in any type of environment, such as aqueous or hydrophilic environments. In the case of a hydrophilic environment, it is advantageous that the carrier fluid be selected to allow for proper dispersion. A dispersant to promote dispersion in the carrier fluid to create the fuel additive is also encompassed in a preferred embodiment. For liquid hydrocarbon fuel applications, at least one carrier fluid can preferably be a hydrophilic fluid that is highly miscible with the fuel.

The fuel additive of the invention is useful to enhance combustion such that more complete combustion is achieved with increased combustion to $CO_2$ and $H_2O$ as compared to the combustion of the fuel without the fuel additive. The outcome is the reduction of products of partial combustion as well as $NO_x$, thereby increasing fuel efficiency.

The fuel additive is used by adding this additive to the fuel in an amount sufficient to increase fuel efficiency or to reduce pollutants. The terms enhanced and enhanced combustion refer to either of these effects. An example of reduced pollutants is a reduction of NOx in an exhaust gas produced from a combustion zone. Advantageously, both of these effects are observed though the addition of the fuel additive of the current invention. A preferred embodiment includes the addition of between about 50 and 150 ppm phosphorus into the fuel though the addition of the fuel additive. Increased amounts of phosphorus are effective as well. It is notable that a very cost-effective solution can be prepared with low weight percent of phosphorus. Another preferred target is around 1 ppm phosphorus to 150 ppm phosphorus. Positive test results have been generated as low as 0.25 ppm phosphorus.

Included in the invention is a process for enhancing fuel performance of a hydrocarbon fuel in a combustion system including the steps of providing the fuel additive described above in an amount effective to enhance fuel performance to the hydrocarbon fuel and combusting the hydrocarbon fuel with the fuel additive. The combustion system can be any means known to those with ordinary skill in the art for combusting hydrocarbon. The combustion system can include one or more combustion zones. In a preferred embodiment, this process is used with a liquid hydrocarbon fuel. Similarly, the additive can be used with a solid hydrocarbon fuel. The result of adding the additive to the hydrocarbon fuel is an enhanced fuel that has a substantial amount of hydrocarbon fuel suitable for combustion, and an amount of the fuel additive operable to enhance combustion. Preferably, the enhanced fuel contains phosphorus in an amount operable to reduce emissions upon combustion of the enhanced fuel as compared to the combustion of the hydrocarbon fuel without the fuel additive. More preferably, the enhanced fuel contains phosphorus of between about 1 and 150 ppm by weight.

An alternate embodiment of the invention includes a process for enhancing fuel performance of a hydrocarbon fuel in a combustion system including the steps of adding a chemical addition composition to the hydrocarbon fuel in an amount effective to enhance fuel performance. The chemical addition composition is created by creating an intermediate solution by (i) mixing in an aqueous medium a source of reactive $NH_2$ groups with one of the following:

(a) an alkali metal hydroxide to raise the pH of the intermediate solution above 12 to form an aqueous ammonium/alkali metal hydroxide; or (b) a source of phosphoric acid to lower the pH of the intermediate solution to about 0 to form an acidic ammonium mixture.

The next step includes either combining the intermediate solution of step (i.a.) with the source of phosphoric acid; or the intermediate solution of (i.b.) with the hydroxide at a rate sufficient to create a highly exothermic reaction. This results in reactive $NH_2$ groups being contained in solution during the formation of the chemical addition composition. This chemical addition composition is added to the hydrocarbon fuel.

The parent solution or the chemical addition composition of the invention can be added into or include a combustion fuel. Again, it can be advantageous to include dispersants to promote dispersion in fuels that are hydrocarbon based. Exemplary fuels include gasoline and diesel fuel.

An enhanced fuel is created when a substantial amount of a fuel suitable for combustion is combined with an amount of the phosphorus-containing parent solution or the chemical addition composition sufficient to reduce emissions or to increase efficiency upon combustion of the enhanced fuel. In certain circumstances, the carrier fluid is a quantity of a target fluid, that is, a fluid that contains the desired fuel.

A composition of phosphoric acid, alkali metal hydroxide and a source of reactive $NH_2$ groups has been explored in U.S. Pat. No. 5,540,788 for the creation of a conversion surface, the disclosure of the patent being incorporated herein by reference. The current invention includes the use of the conversion surface composition as a fuel additive. In one embodiment the fuel additive is chemical addition composition for the enhancement of hydrocarbon fuels where the chemical addition composition has the composition disclosed in U.S. Pat. No. 5,540,788. This embodiment is unique in the use of the source of reactive $NH_2$ groups, which can be advantageous under certain circumstances. While the chemical composition including reactive $NH_2$ groups has certain advantages, it can result in the presence of free ammonia. Various other embodiments of the fuel additive of this invention avoid the production of free ammonia and the related issues.

DETAILED DESCRIPTION

The fuel additive of the invention is believed to perform a gas phase conversion of hydrocarbon fuels to achieve more complete combustion to $CO_2$ and $H_2O$ in the process. Preferably, the fuel additive is provided as a dispersion in carrier fluid. Preparation preferably includes forming the aqueous parent solution that is emulsified and then added into base oils. Dispersion can be aided through the use of emulsifiers and dispersants. In a preferred embodiment, a dispersant with a total base number of from 30 to 160 on an oil-free basis is used. Tests run using infrared and other testing techniques confirm the reduction of CO from the offgas from the combustion of hydrocarbon fuels with the fuel additive of the invention.

Both the new composition disclosed herein and the previously described composition of Defalco can be used to produce the enhanced fuel performance.

The invention includes the use of the fuel additive in the combustion chamber of an engine. This is believed to be particularly valuable for use in diesel engines. Use in the engine appears to provide combustion benefits allowing for a reduction in particulate and other emissions. The process of the invention is effective at the high temperatures produced as part of the combustion process such that the fuel additive can be placed in contact with the metal parts while the engine is running at the high temperature produced by the heat of the combustion process.

Testing indicates that use of the fuel additive in fuel provides protection in that the engine heat is reduced. It is presumed that this is the result of an insulating effect. Also, oxygen radicals are increased. An increase in efficiency is observed. This increase in efficiency can be the result of a catalytic effect during combustion.

One example of a preferred formulation of the invention includes the following ratios: 1.597 mols $KH_2PO_4$, 0.693 mol $K_2HPO_4$, 0.315 mol $[NH_4]_2HPO_4$ and water. The pH of the solution can be controlled through manipulation of the ratios of these components. By manipulating the ratios of the resulting $H_2PO_4^-$ and $HPO_4^{2-}$ ions, the solution can be created in a preferred pH range of about 6.0 to about 8.0.

In a preferred embodiment, $KH_2PO_4$, $K_2HPO_4$, $[NH_4]_2HPO_4$ and water are created into the phosphorus containing parent solution that is added to a carrier fluid, such as a refined oil carrier fluid, and mixed with dispersants. Exemplary dispersants include TFA 4690C, polyalkenyl succinimides, and Oronite ODA 78012 by Chevron or Ethyl Hitec 646 by Ethyl Corporation, Richmond Va. Exemplary carrier fluids include polyoxpropylene monol and polyols, polyoxybutylene monols and polyols, Actaclear ND17 by Bayer, Pittsburg, Pa., and the like. The phosphorus containing parent solution is added in at approximately 10 wt. % of the refined oil carrier fluid. This is heated to drive off a significant amount of the solvent, in this case, water. The mixture can be described at this point as a colloid. When the resulting solution is mixed into the fuel, an effective amount of the phosphorus in the solution can be dilute. One example of a preferred embodiment is 0.3 wt % phosphorus in the solution. Upon addition to the fuel, the phosphorus content can be in the range of 5-100 ppb and still be effective. Preferably, 1-250 ppm phosphorus is used in the fuel. Higher amounts are also effective. More preferably, 1-150 ppm phosphorus by weight is in the fuel with the fuel additive.

An example of an alternate embodiment of the phosphorus-containing parent solution that is for use in fuel includes mixing about 2.6 molar (M) orthophosphate with alkali metal and ammonium cations, the resulting aqueous parent solution having a pH of 7 at ambient temperatures. A measured volume of this aqueous parent solution is suspended in a mixture of refined oil carrier fluid and dispersant, most of the water of the aqueous parent solution is removed thermally, and diluted to about 0.3 weight % P. This mixture is used, with further dilution, as an additive to fuels. The dilution is preferably achieved with the same refined oil carrier fluid. A Group II base oil is preferred. Other preferred carrier fluids include light hydrocarbons, gasoline, polygas, kerosene, diesel, naphtha light oils, Group I, III, IV, V or VI base oils as defined by API, aromatic oils, polybutenes, polyglycols, heavier oils or combinations of the same. The aqueous parent solution prepared in this fashion, when added to fuel, acts is to diminished emission of pollutant molecules under normal engine operating conditions. An example of an alternate embodiment includes the use of phosphoric acid, potassium hydroxide, ammonium hydroxide in water. Acetic acid can also be added. The amounts of the components can be adjusted to reach the desired pH.

EXAMPLE 1

1. Prepare a Phosphoric Acid/Acetic Acid solution [$H_3PO_4$/$HOA_c$ Solution]. For this run, the $H_3PO_4$/$HOA_c$ Solution is about 90% mole of $H_3PO_4$ and 10% mole of $HOA_c$.
2. Prepare for reaction De-ionized water
3. 2,736.39 lbs of the Potassium Hydroxide is added to the water
4. Add to this aqueous solution 1315.14 lbs of the Ammonium Hydroxide (29%)
5. Into the resulting solution, add the $H_3PO_4$/$HOA_c$ Solution and allow for reaction.
6. After reaction, adjust pH with acetic acid to a pH of about 7.0. The resulting product of this reaction is useful as the chemical addition component to enhance hydrocarbon fuel.

EXAMPLE 2

Laboratory tests with the fuel additive of $KH_2PO_4$, $K_2HPO_4$, $[NH_4]_2HPO_4$ in refined oil carrier fluid as an additive in diesel fuels show major improvements in fuel efficiency. Sodium has also been evaluated for use as a cation in this formulation. Group IA metals arc also preferred cations. Factors related to selection of the cation include commercial expense and corrosion resistance.

EXAMPLE 3

Use of the fuel additive described in Example 2 in combination with a low sulfur diesel fuel provided a 74% reduction in CO emissions in the exhaust gas as compared to diesel without the fuel additive, 34% reduction in $SO_2$, and 55% reduction in particulates.

EXAMPLE 4

Use of the fuel additive described above in combination with natural gas showed an 87% reduction in the formation of carbon monoxide as compared to combustion of the natural gas without the fuel additive, and an 18% reduction in NOx.

EXAMPLE 5

| Component | lbs | Unit Ratio weight |
|---|---|---|
| Phosphoric Acid | 2,583 | 0.25 |
| Potassium Hydroxide | 2,736 | 0.26 |
| Ammonium Hydroxide | 1,315 | 0.13 |
| Acetic Acid | 672 | 0.06 |
| Deionized Water | 3,105 | 0.30 |
| Total Phosphorus-Containing Parent Solution | 10,411 | 1.00 |

EXAMPLE 6

| Component | Input Lbs | Unit Ratio weight |
|---|---|---|
| Star 4 Base Oil | 8,544 | 0.79 |
| Kerosene | 1,282 | 0.12 |
| ODA 78012 | 205 | 0.02 |
| Hitec 646 | 205 | 0.02 |
| Actaclear ND 17 | 85 | 0.01 |
| Phosphorus-Containing Parent Solution (Example 5) | 273 | 0.03 |
| Total | 10,748 | 1.00 |

This is further diluted in base oil to adjust to desired concentration of phosphorus in fuel additive. The solvent is removed from the solution in order to create the fuel additive. In this case, the solvent is water and dehydration is accomplished thermally.

An alternate embodiment includes the use of $[NH_4]H_2PO_4$, $[NH_4]_2HPO_4$ and water.

In a preferred embodiment, the solvent is one that is defined by solubility or dispersability of the salts in the solvent as well as the volatility of the solvent. For example, the salts are preferably dispersed throughout the solvent but the solvent is of such volatility that it can be boiled out of solution and preferably recovered for reuse without affecting the resulting product.

While the invention has been shown or described in only some of its forms, it should be apparent to those skilled in the art that it is not so limited, but is susceptible to various changes without departing from the scope of the invention. For example, introduction of the salts into the fuel or the carrier fluid can be accomplished through speed shear mixing without the creation of an intermediate solution and the subsequent thermal removal of the solvent. Regarding the salts, $[Y]_xH_2PO_4$, $[Y]_{x+1}$HPO4 also encompasses $[Y]_x[H_2PO_4]_z$, $[Y]_{x+1}[HPO_4]_z$ where x and z are variable integers.

What is claimed is:

1. A fuel additive comprising a phosphorus-containing parent solution and a carrier fluid, the phosphorus-containing parent solution comprising a mixture of salts, the mixture of salts comprising:

$[Y]_xH_2PO_4$;

$[Y]_{x+1}HPO_4$; and $[NH_4]_2HPO_4$, wherein [Y] is a cation, wherein x is an integer, the carrier fluid being operable to maintain the salts within the carrier fluid in at least a partially dispersed state, the fuel additive being operable to enhance combustion when placed into contact with fuel in a combustion zone and combusted, the enhanced combustion being measurable by increased fuel efficiency or decreased pollutant output in an exhaust gas resulting from the combustion of the fuel and the fuel additive.

2. The fuel additive of claim 1 further comprising $NH_4C_2H_3O_2$ where $C_2H_3O_2$ is an acetate group.

3. The fuel additive of claim 1 wherein the pH of the phosphorus-containing parent solution is between about 6.0 and 8.0.

4. A process for enhancing fuel performance of a hydrocarbon fuel in a combustion system having a combustion zone comprising the steps of providing the fuel additive of claim 1 in an amount effective to enhance fuel performance to the combustion zone and combusting the hydrocarbon fuel with the fuel additive.

5. The process of enhancing fuel performance of claim 4 wherein the hydrocarbon fuel is a liquid hydrocarbon fuel.

6. The process of enhancing fuel performance of claim 4 wherein the hydrocarbon fuel is a solid hydrocarbon fuel.

7. An enhanced fuel comprising a substantial amount of hydrocarbon fuel suitable for combustion, and an amount of fuel additive of claim 1 operable to enhance combustion.

8. The enhanced fuel of claim 7 wherein phosphorus is present in the hydrocarbon fuel in an amount of between about 1 and 150 ppm by weight.

9. The enhanced fuel of claim 7 wherein the amount of fuel additive is the amount operable to reduce emissions upon combustion of the enhanced fuel as compared to the combustion of the hydrocarbon fuel without the fuel additive.

10. A process for creating a fuel additive for enhancing combustion of a hydrocarbon fuel, the process comprising the steps of:

Mixing the salts $[Y]_xH_2PO_4$ $[Y]_{x+1}HPO_4$, and $[NH_4]_2HPO_4$, wherein [Y] is a cation and wherein x is an integer, in a solvent to at least partially disperse the salts in the solvent to create a phosphorus-containing parent solution;

Mixing the phosphorus-containing parent solution with a carrier fluid such that the phosphorus-containing parent solution is generally dispersed in the carrier fluid;

Removing a substantial portion of the solvent from the mixture of the phosphorus-containing parent solution with the carrier fluid to create a fuel additive that is operable to enhance combustion when added to a combustion zone in the presence of a hydrocarbon fuel and combusted.

* * * * *